United States Patent [19]

Arthur

[11] 4,016,378

[45] Apr. 5, 1977

[54] DETENT MEANS FOR SIMPLIFIED SLIDE SWITCH

[75] Inventor: Ronald H. Arthur, Fort Lauderdale, Fla.

[73] Assignee: AMF Incorporated, White Plains, N.Y.

[22] Filed: Mar. 9, 1976

[21] Appl. No.: 665,284

[52] U.S. Cl. ..... 200/16 D; 200/291; 200/293; 200/295

[51] Int. Cl.[2] ..... H01H 15/04; H01H 9/02

[58] Field of Search ..... 200/16 R, 16 C, 16 D, 200/16 F, 60, 291, 293–296; 74/527

[56] References Cited

UNITED STATES PATENTS

| | | | |
|---|---|---|---|
| 3,072,757 | 1/1963 | Gluck | 200/16 D |
| 3,174,002 | 3/1965 | Golbeck | 200/16 D |
| 3,229,053 | 1/1966 | Smith | 200/16 D |
| 3,485,966 | 12/1969 | Bailey et al. | 200/16 D |
| 3,525,828 | 8/1970 | Eckhart et al. | 200/16 D |
| 3,592,983 | 7/1971 | Kroll et al. | 200/16 D |
| 3,674,953 | 7/1972 | Brevick | 200/16 D X |
| 3,849,610 | 11/1974 | Lockard et al. | 200/16 R X |
| 3,983,341 | 9/1976 | Stanish | 200/16 D |

*Primary Examiner*—James R. Scott
*Attorney, Agent, or Firm*—George W. Price; John H. Gallagher

[57] ABSTRACT

A simple inexpensive slide switch is disclosed having a unitary plastic slide member serving the dual function as a switch housing and actuator. The plastic member is slidably mounted to the insulator base member by flexible side skirts having barbs extending inwardly and disposed in sliding engagement with the base member undersurface. The flexible side skirts and base member have complementary boss means and boss receiving means to provide detent type operation.

11 Claims, 7 Drawing Figures

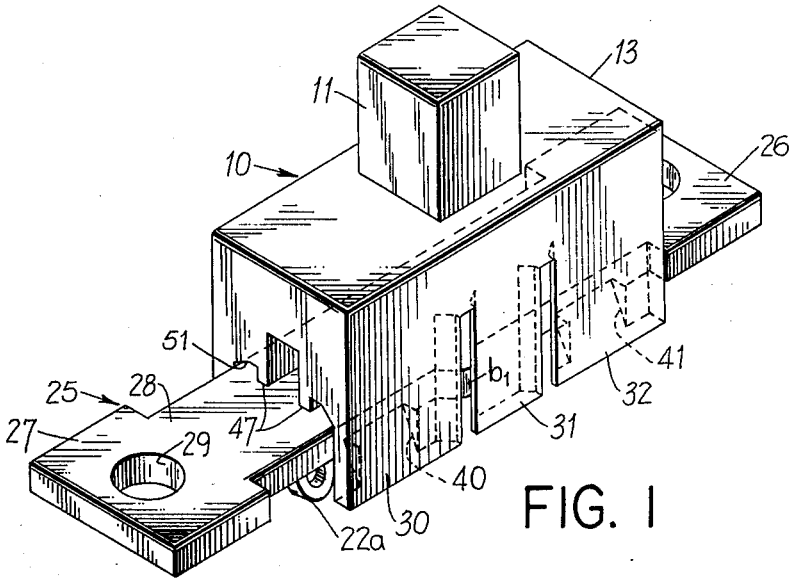
FIG. 1
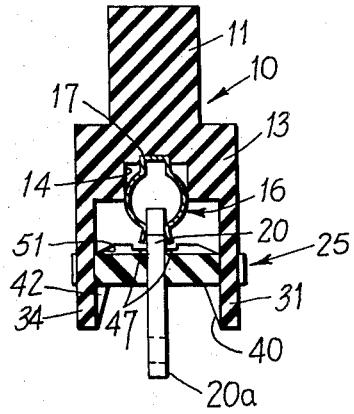
FIG. 2
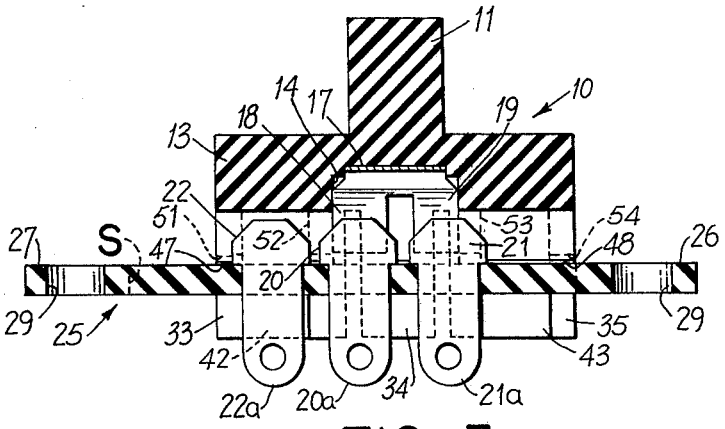
FIG. 3
FIG. 4
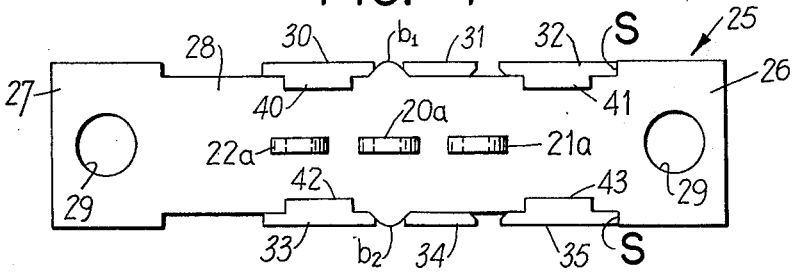

DETENT MEANS FOR SIMPLIFIED SLIDE SWITCH

BACKGROUND OF THE INVENTION

A simple, inexpensive slide switch is known which is comprised of a unitary plastic slide member having an upper portion whose underside is recessed to receive an insertable sliding contact. The slide member further includes yieldable side skirts of relative thin plastic which extend downwardly beyond the edges of an insulator base member which has mounted thereon two or more spaced stationary contacts and corresponding connector terminals. Along the bottom edge of each of the side skirts are inwardly projecting barbs or latch members which slidingly engage the bottom surface of tha base member, thus holding the switch together.

When switches of this type are made in a miniature or subminiature size the component parts are small and do not have substantial mechanical strength. This together with the base that dimensional tolerances are not too strict, the switches sometimes do not have a pronounced switching "feel" or "click" which some users prefer. Also, sometimes the plastic slide members of these very small switches are not positively retained at their various switching positions.

SUMMARY OF THE PRESENT INVENTION

According to one embodiment of the present invention a switch of the described type is provided with a "feel" or positive switching action by separating each side skirt on the slide member into three slightly spaced-apart individual skirts. Outwardly extending bosses are provided on the opposite edges at the mid region of the insulator base member. The middle one of the skirts on each side of the slide member is yieldable and upon sliding motion of the plastic slide member, the bosses urge the middle skirts outwardly as they move over the bosses. At the extreme limits of movement of the slide member, the boss on each edge of the insulator base member is in registration with the space between adjacent individual side skirts, thus allowing the yieldable middle skirts to return to their normal positions. With the bosses located in the spaces between adjacent side skirts, the movable member is yieldably held in its extreme switching position.

BRIEF DESCRIPTION OF THE DRAWINGS

FIG. 1 is a perspective view of a slide switch constructed in accordance with the present invention;

FIG. 2 is a sectional view taken at section 2—2 of FIG. 1;

FIG. 3 is a longitudinal sectional view of the switch of FIG. 1;

FIG. 4 is a bottom view of the switch of FIG. 1; and

DESCRIPTION OF PREFERRED EMBODIMENT

Figure 5:
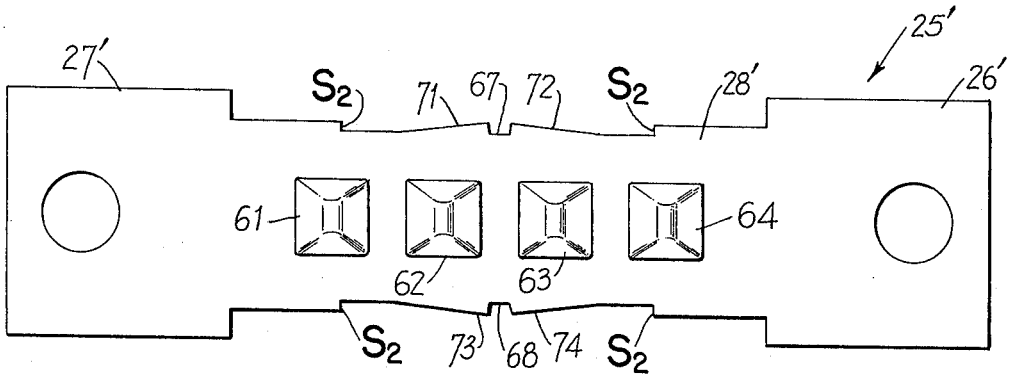
FIGS. 5–7 are illustrations of an alternative embodiment of a switch constructed in accordance with this invention.

Referring to FIGS. 1–3, switch includes a molded plastic unitary slide member 10 having an actuator button 11 extending from its top surface. The upper portion 13 of slide member 10 is substantially solid except for a hollow recess 14, FIGS. 2 and 3, into which is fitted a double wipe sliding contact 16. As best seen in FIG. 2, sliding contact 16 has a somewhat U-shaped cross section with the mid region of the two sides bowed outwardly to contact the side walls of hollow recess 14. As seen in FIG. 3, sliding contact 16 has fore and aft wiper portions 18 and 19 which are joined by a bridging portion therebetween. Sliding contact 16 is made of a resilient conductive material and its U-shaped fore and aft portions are adapted to make sliding contact with blade-like stationary contacts 20, 21 and 22.

Stationary contacts 20, 21 and 22 extend upwardly from the top surface of an insulator base member 25. Corresponding connector terminals 20*a*, 21*a*, and 22*a* extend downwardly from the opposite surface of base member 25.

As best seen in the bottom view of FIG. 4, insulator base member 25 is comprised of two wide end portions 26 and 27 and an intermediate portion 28 of reduced width. Right angle shoulders or stops s are formed at the four corners where the intermediate portion 28 joins the wider end portion 26 and 27. Mounting holes 29 are included in each of the end portions. Midway along the intermediate portion 28 small triangular-shaped bosses $b_1$ and $b_2$ extend outwardly from the respective edges. Base member 25 is retained within the unitary plastic slide member 10 by means now to be described.

As seen in FIGS. 1 and 4, each side of slide member 10 is comprised of three spaced apart and yieldable side skirts 30, 31, 32 and 33, 34, 35, respectively, which continue downwardly from the upper portion 13 of slide member 10. All of the side skirts 30-35 extend down beyond insulator base member 25. The end ones of the side skirts 30, 32, 33 and 35 have triangular shaped barbs or latch elements 40, 41, 42 and 43 which have horizontal top surfaces that extend inwardly for slidingly engaging the under side of base member 25.

On the underside of the upper portion 13 of slide member 10, at the opposite end regions that are located between opposite side skirts 30, 33 and 32, 35, respectively, pairs of spaced ridges 47 and 48 extend downwardly toward insulator base member 25. Also, at the ooposite ends of each pair of the downwardly extending pairs of ridges 47 and 48, web-like sections 51–58, see FIGS. 1 and 3, are molded as part of slide member 10 to add some stiffening to the end side skirts 30, 32, 33 and 35. The reason for including the stiffening web-like sections 51–58 will be explained below. As seen in FIG. 4, adjacent edges of adjacent side skirts are inclined away from each other so as to form V-shaped notches or voids therebetween.

To assemble the switch, slide member 10 is placed upside down and resilient sliding contact 16 is placed within hollow recess 14. One edge of the intermediate portion 28 of insulator base member 25 then is placed under the inwardly extending barbs or latch elements 30 and 32, for example, and the other edge of base member 25 is pushed down until it snaps under the other pair of barbs 33 and 35. Base member 25 is now slidingly retained between the four barbs or latch elements 30, 32, 33, 35 and the two pairs of ridges 47 and 48 that extend downwardly from the underside of the upper portion 13 of slide member 10.

The shoulders s constitute stops that limit the sliding motion of slide member 10. When slide member 10 is at its extreme positions at opposite ends of intermediate portion 28 it is in its respective two switching positions. In one of those positions, double wipe sliding contact 16, FIG. 3, connects the stationary contacts 20 and 21, and at the other switching position stationary contacts 20 and 22 are connected together.

In slide switches constructed in miniature and subminiature sizes, the component parts are extremely small and the sliding contacts are quite thin and resilient. Consequently, there is very little "feel" or "snap" in the switching action. Additionally, because of necessary clearances and tolerances, there may be some tendency for the sliding member 10 and sliding contact 16 to creep or drift away from their extreme switching positions. In accordance with this invention, a positive "feel" and a retention feature is built into the slide action of the switch. These features are provided by the cooperative action of bosses $b_1$ and $b_2$, FIG. 4, that extend outwardly from the edges of intermediate portion 28 of base member 25. As illustrated in FIG. 4, when slide member 10 is in its extreme right switching position, bosses $b_1$ and $b_2$ are positioned in the V-shaped notches between adjacent side skirts 30, 31 and 33, 34, respectively. When slide member 10 is moved toward its left switching position bosses $b_1$ and $b_2$ urge against the inclined sides of the middle side skirts 31 and 34 and urge them outwardly. When slide member 10 reaches its extreme left switching position at the extreme left end of intermediate portion 28, bosses $b_1$ and $b_2$ will be positioned in the V-shaped notches between side skirts 31, 32 and 34, 35. In this position the middle side skirts 31 and 34 will have returned to their normal positions to hold slide member 10 in its desired switching position. Middle side skirts 31 and 34 are flexible and yieldable to allow them to be urged outwardly by bosses $b_1$ and $b_2$. Side skirts 30, 32, 33 and 35 also are yieldable to allow insulator base member 25 to be snapped therebetween, but because of the stiffening web-like sections 51–58, FIG. 3, they are not as yieldable as the center skirts 31 and 34. This assures that base member 25 will be retaned by the barbs or latch elements 40–43 during switching action.

It is to be understood that base member 25 could include only two stationary contacts, or it could include more than three contacts. Correspondingly, the switching action could be single throw or multiple throw. For multiple throw switching, base member 25 could have a plurality of bosses $b_1$ and $b_2$ spaced along its intermediate portion. It will be appreciated that only one boss on one edge of base member 25 actually is required for each switching position.

Also in keeping with the teachings of this invention, although not presently preferred, it is possible to have just two spaced apart side skirts on each side of slide member 10 and one or more longitudinally spaced bosses on base member 10. In such an embodiment, the detent means should be short so as not to cause the barbs 40–43 to become disengaged from the bottom surface of base member 10.

Figure 6:
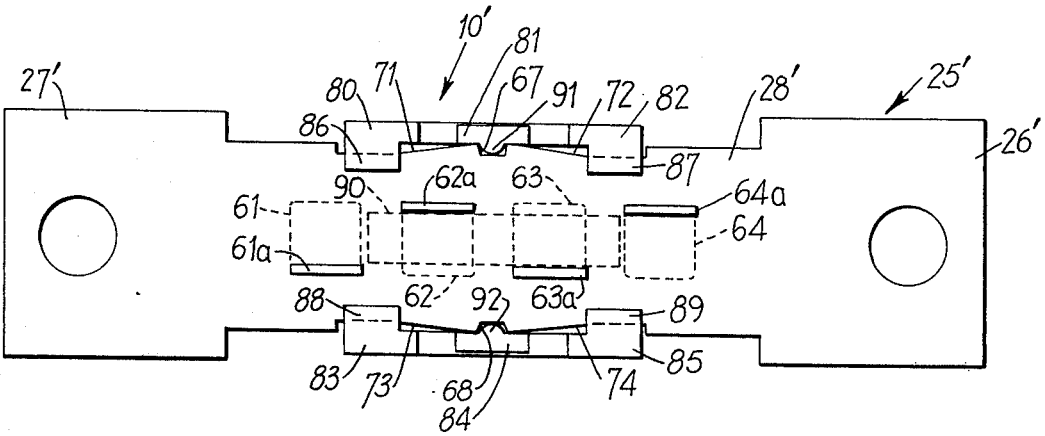
Figure 7:
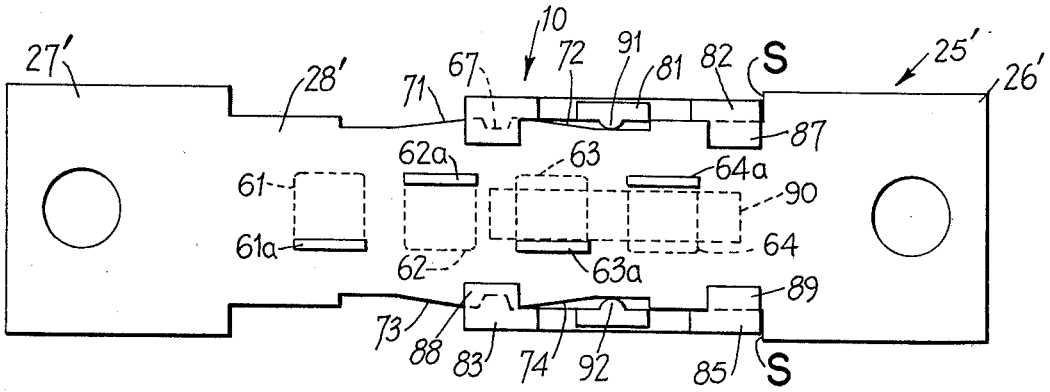

Also in keeping with this invention, the bosses could be molded into the side skirts and indentations or notches could be provided in the edges of base member 10. A presently preferred embodiment of this type is illustrated in FIGS. 5–7. As seen in FIG. 5, insulator base member 25' is comprised of two wide end portions 26' and 27' and a more narrow intermediate portion 28'. The central region of intermediate portion 28' includes dome shaped stationary contacts 61–64 on one face thereof. Respective connector terminals **61*a*–64*a* extend through insulator base member 25'** and project outwardly from the opposite face.

The opposite edges of the central region of intermediate portion 28' includes respective indentations or notches 67 and 68. The edges at the central region also include the ramps 71 and 72 which are inclined inwardly as they extend away from notch 67 and the ramps 73 and 74 slope inwardly as they extend away from notch 68. Intermediate stops *s*2 are formed in the regions at the bases of ramps 71–74 and the edges of intermediate region 28'.

The upper portion of plastic unitary slide member 10' may be substantially identical to that illustrated in FIG. 1. Slide member 10' will include within it a cavity for receiving a spring contact member which makes selective sliding contact with the stationary contacts as the slide member 10' is moved between its switching positions. Sliding contacts of this type are well known and are shown in U.S. Pat. No. 3,674,953 issued to A. Brevick, for example.

As seen in FIGS. 6 and 7, each side of slide member 10' includes three spaced apart yieldable side skirts 80, 81, 82 and 83, 84, 85, respectively, which extend downwardly beyond insulator base member 25'. The end ones of the side skirts 80, 82, 83 and 85 have triangular shaped barb or latch elements 86, 87, 88 and 89, respectively, which slidingly engage the under side of base member 25' in the same manner as described in connection with FIGS. 1–4.

The center ones of the side skirts 81 and 84 have respective bosses 91, 92 projecting from their inner surfaces for releasably seating in the notches 67 and 68 in base member 25'.

FIG. 6 illustrates sliding member 10' in the center one of its three switching positions. In this position, sliding contact 90, which is held in a cavity in plastic slide member 10' in a conventional manner, establishes electrical connection between stationary contacts 62 and 63 on base member 25'. It may be seen in FIG. 6 that the outermost side edges of flexible skirts 80, 82, 83 and 84 are substantially butting the intermediate stops *s*2. This relationship helps to maintain plastic slide member 10' in its center switching position.

FIG. 7 illustrates the plastic slide member 10' in its far right switching position wherein the sliding contact 90 establishes electrical connection between stationary contact 63 and 64. It is seen that the right edges of opposite side skirts 82 and 85 are against stops s which are located where intermediate portion 28' meets the right end portion 26'. The bosses 91 and 92 on the center ones of the side skirts 81 and 84 are positioned proximate the bases of the ramps 72 and 74. Because ramps 72 and 74 are inclined inwardly from the edges of base member 25' the center ones of the side skirts 81 and 84 are not stressed outwardly but are in a substantially unstressed condition. This feature minimizes the possibility that the middle ones of the side skirts having the bosses thereon will take on a permanent set in an outwardly extended position.

When member 10' is switched to its extreme left position its arrangement on base member 25' will be just opposite from that illustrated in FIG. 7.

It is believed that various other embodiments of this invention now will be suggested to those skilled in the art. For example, single pole or multiple pole, and single throw or multiple throw features may be combined in various combinations by employing the teachings of this invention. Additionally it is possible to provide a long array of many single or multiple pole stationary contacts on an insulator base member having thereon bosses or detents of the types described above. Cooperating with this long array of stationary contacts may be one or more slide members of the types described above, each having the desired sliding contacts to establish electrical connection between respective adjacent stationary contacts. An arrangement of this general type showing but a single slide member is illustrated in FIGS. 7 and 8 of the above-mentioned U.S. Pat. No. 3,674,953.

In its broader aspects, this invention is not limited to the specific embodiments illustrated and described. Various changes and modifications may be made without departing from the inventive principles herein disclosed.

What is claimed is:

1. An improved slide switch comprising a thin insulator base member having two end portions and an intermediate portion therebetween, a plurality of stationary contacts extending from one surface of the base member in said intermediate portion, a plurality of terminal means for said stationary contacts, a sliding member formed as a unitary plastic piece having an upper portion extending transversely of the intermediate portion of said base member and including on two sides thereof yieldable side skirts adapted to extend downwardly over the side edges of said intermediate portion of the base member, barbs or latch elements at the bottom portions of said skirts for slidingly engaging the opposite surface of the base member to maintain said sliding member and base member in operable relationship, a movable contact member disposed between the sliding member and said stationary contacts and operable in response to the sliding motion of the sliding member for selectively making and breaking contact with said stationary contacts, boss means and boss receiving means, one of which is associated with at least an edge of said base member and the other one being associated with said yieldable side skirts, said boss means and boss receiving means being constructed and arranged to be in registration with each other when the sliding member is in at least one desired switching position, and registration between the boss means and boss receiving means being interrupted due to yielding of at least one side skirt during motion of the sliding member away from said one desired switching position.

2. The improved slide switch claimed in claim 1 wherein, said boss means is associated with at least one of said side skirts and located on an inner surface thereof adjacent a side edge of said intermediate portion of the base member, and wherein said boss receiving means is a notch or indentation in said adjacent side edge of the base member.

3. The improved slide switch claimed in claim 2 wherein at least one side skirt is comprised of at least three adjacent individual side skirts and said boss means is located on an individual skirt intermediate the end ones of the individual skirts.

4. The improved side skirt claimed in claim 2 wherein said adjacent side edge of the base member which has the boss receiving notch or indentation therein is inclined inwardly as the edge extends longitudinally away from said notch or indentation, thereby to form a ramp like configuration on each side of said notch or indentation.

5. The improved slide switch claimed in claim 1 wherein, at least one side skirt is comprised of a plurality of adjacent individual side skirts having a void space between at least two adjacent individual skirts, said void space comprising said boss receiving means, said boss means comprising at least one extension from side edge of said base member, and said extending boss means being constructed and arranged to be received and yieldingly retained within said void space when the sliding member is in said one desired switching position.

6. The improved slide switch claimed in claim 2 wherein the side skirt on at least one side of the sliding member is comprised of at least three spaced individual skirts having at least two void spaces therebetween, an intermediate one of the individual side skirts being yieldable and having a predetermined length to define first and second desired switching positions for the sliding member when said extending boss means is in registration with the respective void spaces on opposite sides of said middle individual side skirt.

7. An improved slide switch comprising a thin insulator base member having two end portions and an intermediate portion therebetween, a plurality of stationary contacts extending from one surface of the base member in said intermediate portion, a plurality of terminal means for said stationary contacts, a movable contact means adapted for selective engagement with said stationary contacts, a sliding member adapted to place said movable contact means in engagement with one or more selected ones of said stationary contacts when said sliding member is in a switching position, said sliding member being a unitary plastic piece having an upper portion extending transversely of the intermediate portion of said base member and including on two sides thereof yieldable side skirts adapted to extend downwardly over the side edges of said intermediate portion of the base member, barbs or latch elements at the bottom portions of said skirts for slidingly engaging the opposite surface of the base member to maintain said sliding member, said base member and said contacts in operable relationship, boss means and boss receiving means, one of which is associated with said base member and the other one being associated with said side skirts, said boss means and boss receiving means being constructed and arranged to be in registering contact with each other when the sliding member is in at least one of its switching positions.

8. The combination claimed in claim 7 wherein engagement between said boss means and at least one yieldable side skirt flexes that side skirt away from the base member when the sliding member is moved from said one switching position.

9. An improved slide switch comprising a thin insulator base member having two end portions and an intermediate portion therebetween, a plurality of stationary contacts extending from one surface of the base member in said intermediate portion, a plurality of terminal means for said stationary contacts, movable contact means adapted for selective engagement with one or more of said stationary contacts, a sliding member adapted to place said movable contact means in engagement with one or more selected ones of said stationary contacts when said sliding member is in a switching position, said sliding member being a unitary plastic piece having an upper portion extending transversely of the intermediate portion of said base member and including on each side thereof a plurality of spaced, yieldable side skirts adapted to extend downwardly over the side edges of said intermediate portion of the base member, one or more barb or latch elements at the lower portions of at least some of the side skirts on each side of the sliding member for slidingly engaging the opposite surface of the intermediate portion of said base member, thereby to maintain said sliding member, said base member and said contacts in operable relationship, boss means and cooperating void or recess means, one associated with said base member and the other associated with said skirts, said boss means registering with said void or recess when the sliding member is in at least one of its switching positions and causing at least one yieldable skirt on the sliding member to flex away from the base member during movement of the sliding member away from said one switching position.

10. An improved slide switch comprising a thin insulator base member having two end portions and an intermediate portion therebetween, a plurality of stationary contacts extending from one surface of the base member in said intermediate portion, a plurality of terminal means for said stationary contacts, a sliding contact adapted for sliding engagement with said stationary contacts, a sliding member adapted to receive said sliding contact and hold it in engagement with one or more selected ones of said stationary contacts when said sliding member is in a switching position, said sliding member being a unitary plastic piece having an upper portion extending transversely of the intermediate portion of said base member and including on two sides thereof a plurality of spaced, yieldable side skirts adapted to extend downwardly over the side edges of said intermediate portion of the base member, one or more barb or latch elements at the lower portions of at least some of the side skirts on each side of the sliding member for slidingly engaging the opposite surface of the intermediate portion of said base member, thereby to maintain said sliding member, said base member and said contacts in operable relationship, boss means on at least one edge of said intermediate portion of the base member, at least one pair of said adjacent side skirts being separated to form a void therebetween to selectively receive said boss means, said boss means being so constructed, located and arranged relative to said void between adjacent side skirts to yieldingly hold said sliding member in a desired switching position.

11. An improved slide switch comprising a thin insulator base member having two end portions and an intermediate portion therebetween, a plurality of stationary contacts extending from one surface of the base member in said intermediate portion, a plurality of terminal means for said stationary contacts extending from said base member, a sliding contact adapted for sliding engagement with said stationary contacts, a sliding member adapted to receive said sliding contact and hold it in engagement with one or more selected ones of said stationary contacts when said sliding member is in a switching position, said sliding member being a unitary plastic piece having an upper portion extending transversely of the intermediate portion of said base member and having on two sides thereof at least three spaced, yieldable side skirts extending downwardly, the side skirts on the two sides of the sliding member being adapted to receive therebetween said intermediate portion of the base member, a barb or latch element at the bottom portion of the outermost ones of the side skirts on each side of the sliding member for slidingly engaging the opposite surface of the intermediate portion of said base member, thereby to maintain said sliding member, said base member and said contacts in operable relationship, boss means on an intermediate one of the yieldable side skirts, said boss means extending inwardly toward a side edge of said intermediate portion of the base member, and boss receiving means composed of a notch or recess in said side edge of the intermediate portion of the base member which is proximate said boss means, said boss receiving means being adapted to releasably receive said boss means when said sliding member is in a given position on said base member, said boss means and boss receiving means operating to urge outwardly the intermediate yieldable side skirt having the boss means thereon when said sliding member is moved away from said given position.

* * * * *